US008209064B2

(12) United States Patent
Segall

(10) Patent No.: US 8,209,064 B2
(45) Date of Patent: Jun. 26, 2012

(54) BALLISTIC ROBOTIC VEHICLE

(76) Inventor: Stuart C. Segall, La Jolla, CA (US)

( * ) Notice: Subject to any disclaimer, the term of this patent is extended or adjusted under 35 U.S.C. 154(b) by 391 days.

(21) Appl. No.: 12/430,720

(22) Filed: Apr. 27, 2009

(65) Prior Publication Data

US 2010/0274413 A1 Oct. 28, 2010

(51) Int. Cl.
*G05D 1/02* (2006.01)
*F41H 7/02* (2006.01)
*B23P 11/00* (2006.01)

(52) U.S. Cl. ..... 701/2; 701/1; 701/36; 434/11

(58) Field of Classification Search ..... 701/2, 1, 701/36; 434/11; 52/125.3, 125.4, 649.1
See application file for complete search history.

(56) References Cited

U.S. PATENT DOCUMENTS 3,917,270 A * 11/1975 Gothard et al. ..... 273/359
4,126,312 A * 11/1978 Kreuzer et al. ..... 273/359
4,155,554 A 5/1979 Adamski et al.
4,316,404 A 2/1982 Medlin
4,352,316 A 10/1982 Medlin
4,515,374 A * 5/1985 Herren, Jr. ..... 273/359
5,856,629 A * 1/1999 Grosch et al. ..... 89/1.13
6,327,954 B1 12/2001 Medlin
7,222,562 B2 5/2007 Smiley
7,225,717 B2 6/2007 Williams
7,284,470 B2 * 10/2007 Huber et al. ..... 89/36.02
7,393,045 B1 7/2008 Gonzalez
7,401,540 B1 7/2008 Kocher
7,712,409 B2 * 5/2010 Cunningham et al. ..... 89/36.09

* cited by examiner

*Primary Examiner* — Tan Q Nguyen
(74) *Attorney, Agent, or Firm* — Gary L. Eastman, Esq.

(57) ABSTRACT

A mobile target assembly for use in small arms practice includes an armor-protected automotive unit with remote control for movement through a target area. Further, the target assembly includes a plurality of repairable/replaceable façades, wherein a selected façade is mounted on the automotive unit. For the present invention, the façade is formed as a land vehicle body and is constructed for intentional destruction by the small arms fire. Importantly, the armor protection provides survivability for the automotive unit in response to small arms fire.

17 Claims, 2 Drawing Sheets

BALLISTIC ROBOTIC VEHICLE

FIELD OF THE INVENTION

The present invention pertains generally to a reusable target for small arms practice. More specifically, the present invention pertains to remotely controlled moving targets. The present invention is particularly, but not exclusively useful as a moving target having a selectively repairable/replaceable façade structure, and an armor-protected automotive unit that is survivable for repetitive reuse with a plurality of different façades.

BACKGROUND OF THE INVENTION

When one's physical safety is involved, the response to a threat from another relies on many factors. In particular, a response to threats in a combat, or quasi-combat environment must be as instinctive as possible, and it must be appropriate for elimination of the threat. This requires both preparation and training.

A realistic environment for training is a significant consideration when preparing an individual(s) to encounter a life-threatening situation. In a combat environment where there are many different types of threats, it is all the more important that an individual be able to identify and properly respond to each threat. With this in mind, a situation of particular importance in today's conflicts arises wherever a conventional looking land vehicle (i.e. an unarmored vehicle) drives into a potential strike zone without proper identification or authorization. In a combat environment, even though the vehicle may look like a car, truck or some other non-military vehicle, a justifiable response to this situation is to engage the vehicle with small arms fire.

In preparation for a situation as presented above, a realistic target should be used for training purposes. It must look like a vehicle, move like a vehicle, and sound like a vehicle. Further, the action that is taken to nullify (eliminate) such a target must be the same as will be used for a response to such a threat in actual combat. Specifically, this means the land vehicle (target) will be engaged by small arms fire. In this case, the term "small arms" means any portable firearm (e.g. rifles, pistols and light machine guns). As a practical matter, however, this may also include 50 cal. weapons. In any event, when a vehicle (training target or otherwise) is engaged, the expectation is that the target vehicle will be destroyed. This can be expensive. Particularly, when a large number of target vehicles are needed during a training cycle.

In light of the above, it is an object of the present invention to provide a mobile target assembly (i.e. target vehicle) having a façade that can be repaired/replaced for a subsequent training exercise, after being damaged/destroyed by small arms fire. Another object of the present invention is to provide a target vehicle having an armor-protected automotive unit that is survivable for subsequent use after being attacked by small arms fire. Still another object of the present invention is to provide a mobile target assembly that is easy to manufacture, is simple to use and is comparatively cost effective.

SUMMARY OF THE INVENTION

A mobile target assembly in accordance with the present invention includes an automotive unit that is mounted on a chassis. Also included is an armored shell. Specifically, the armored shell is formed with a compartment for receiving the automotive unit therein when the armored shell is mounted on the chassis. With this configuration, the automotive unit is enclosed and is effectively protected by the armored shell. Further, the mobile target assembly includes a façade that is selectively affixed to the armored shell. The purpose of the façade is to give the target assembly a visual presentation that is representative of a land vehicle (e.g. a civilian car or commercial type truck).

For the present invention there are a plurality of different façades. Only one façade, of course, is selectively useable for the target assembly at a time. In detail, each façade is manufactured using a plastic foam type material, and it is shaped to represent a conventional land vehicle. Importantly, each façade is repairable/replaceable. Thus, when a façade is damaged or destroyed, it can either be repaired for reuse, or it can simply be discarded.

As indicated above, the armored shell of the target assembly structurally supports a selected façade. Additionally, the armored shell is designed to enclose and protect the automotive unit during use of the target assembly. For this purpose, the armored shell is mounted on the chassis. With this structural combination in mind, a description of the armored shell is perhaps best appreciated using a chassis-based reference system. Specifically, consider that the chassis defines a base plane and a central axis that is perpendicular to the base plane. In relation to this reference system, the armored shell has an upper portion and a lower portion. In detail, the upper portion includes a plurality of panels, and each of these panels is inclined relative to the base plane at a respective angle $\alpha$. In general, the angle $\alpha$ is in a range between 20° and 45°. Further, the lower portion also includes a plurality of panels. Similarly, each panel of the lower portion is inclined relative to the base plane at a respective angle $\beta$. In general, the angle $\beta$ is in a range between 20° and 45°. Also, the upper portion is joined to the lower portion to establish a periphery surrounding the central axis, wherein each panel of the upper portion and each panel of the lower portion extend a respectively predetermined distance from the periphery. Additionally, the armored shell includes a top plate that is affixed to the upper portion to establish the compartment between the top plate, the upper portion and the lower portion. Preferably, the top plate and the panels are made of AR 500.

For an operation of the present invention, a façade is selected and mounted on the armored shell. The automotive unit is then activated. For the present invention, the automotive unit includes a remote control unit for steering the target assembly. It also includes a propulsion unit that is responsive to the control unit for controlled movement of the target assembly. Although the control unit will preferably include a steering lever and a throttle lever, any type of remote controls that are well known in the pertinent art can be used. In any event, the control unit is used to move the target assembly into a target area.

As envisioned for the present invention, the moving target assembly is intended for use in a training exercise to pose a realistic threat to trainees (e.g. soldiers and marines) within the target area. The expectation here is that the trainees will respond to the perceived threat (i.e. vehicle incursion into the target area) with small arms fire. Specifically, it is expected this small arms fire will damage or destroy the façade. It is also expected, however, that due to the armored shell, the small arms fire will not damage or destroy the automotive unit. Instead, in accordance with the present invention, a new (repaired or replacement) façade can be affixed to a previously used armored shell for subsequent use as a mobile vehicle target assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
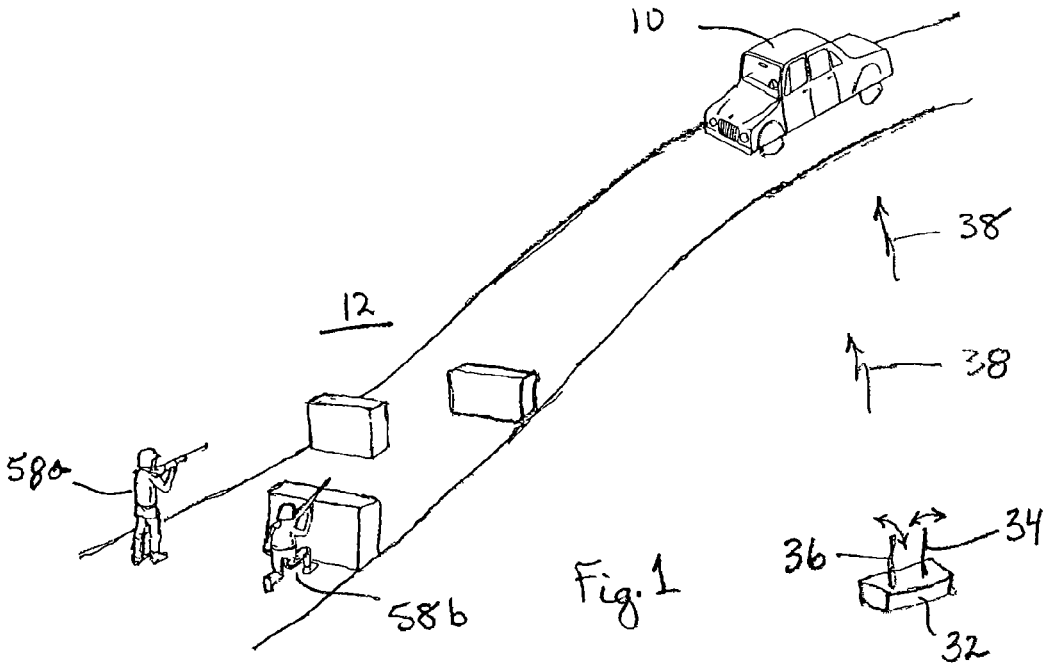
FIG. 1 is a perspective view of an operational environment for use of the target assembly in accordance with the present invention.

Referring initially to FIG. 1 a mobile target assembly in accordance with the present invention is shown and is designated 10. As shown in FIG. 1, the target assembly 10 is approaching a target area 12 where it will be engaged with small arms fire. For purposes of the present invention, the target assembly 10 includes three major components. These components are best seen in FIG. 2 and are: a façade 14, an armored shell 16 and a chassis 18.

Figure 2:
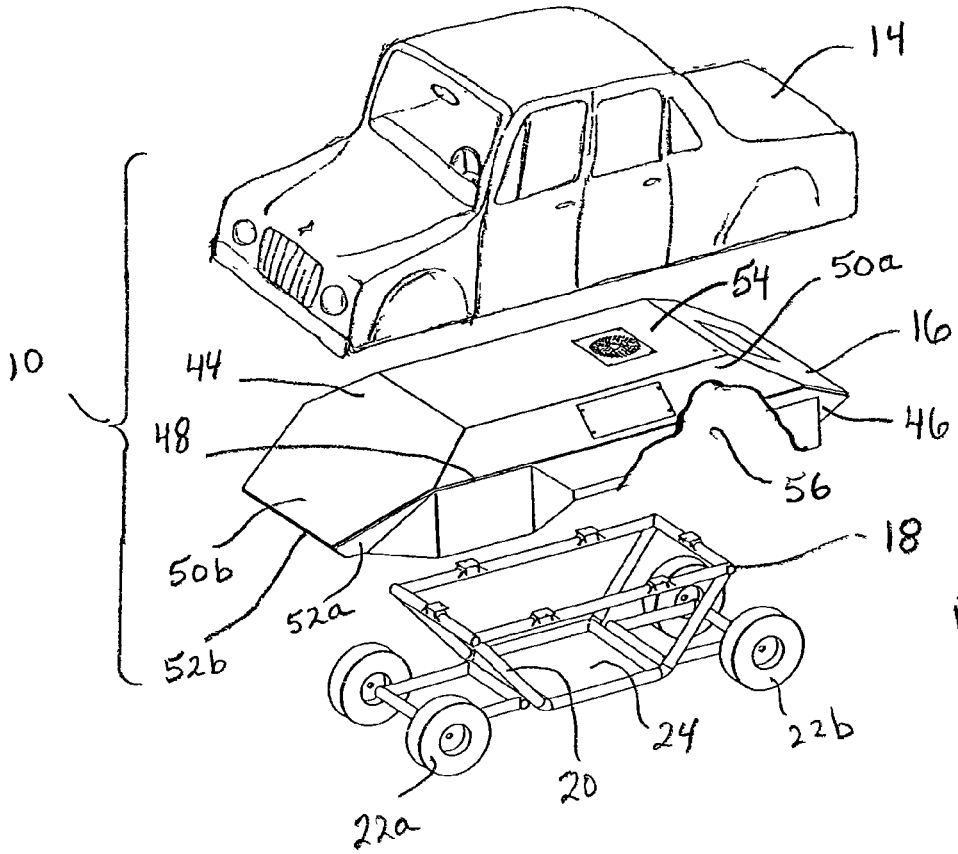
FIG. 2 is an exploded perspective view of the mobile vehicle target assembly with portions broken away for clarity.

With reference to FIG. 2 it will be appreciated that, in combination, the armored shell 16 is mounted on the chassis 18, and the façade 14 is affixed to the armored shell 16. In detail, FIG. 2 shows the chassis 18 includes a support structure 20 that is used for mounting the armored shell 16 on the chassis 18. Further, as shown, the chassis 18 includes tires 22, of which the tires 22*a* and 22*b* are exemplary. Preferably, the tires 22 are of a solid rubber, ballistic type construction that can substantially resist debilitating damage from small arms fire. Also, the support structure 20 is shown to include a cradle 24. Specifically, the cradle 24 is intended to hold an automotive unit such as one schematically shown in FIG. 3 and generally designated 26. As also shown in FIG. 3 the automotive unit 26 includes a remote control unit 28 and propulsion unit 30.

Figure 3:
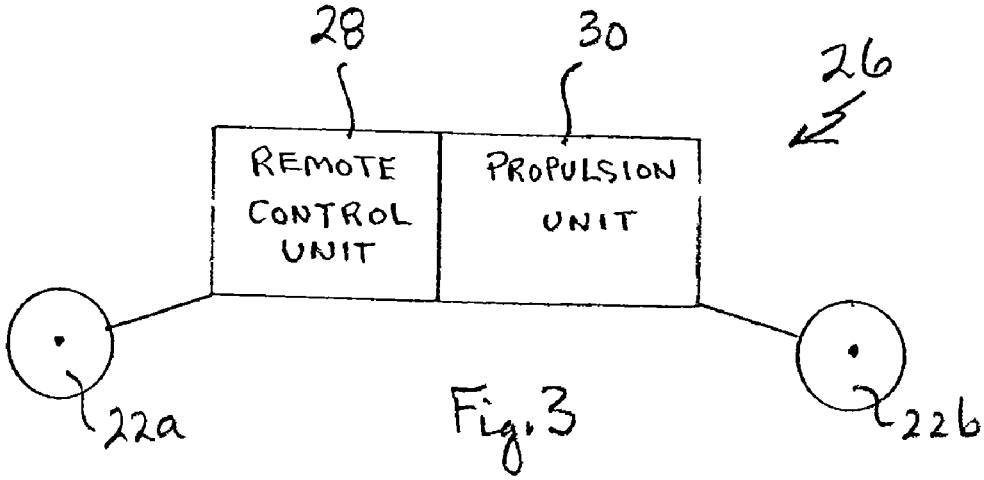
FIG. 3 is a schematic diagram of the automotive unit of the target assembly.

FIG. 3 indicates that the remote control unit 28 of the automotive unit 26 is operationally connected to the front tires 22 (i.e. tire 22*a*) of the target assembly 10. Further, FIG. 3 indicates that the propulsion unit 30 of the automotive unit 26 is operationally connected to the rear tires 22 (i.e. tire 22*b*) of the target assembly 10. By cross-referencing FIG. 3 back with FIG. 1, it will be appreciated that a control box 32 can be employed somewhere in the target area 12 to operate the automotive unit 26. Specifically, by using a steering lever 34 and a throttle lever 36 on the control box 32, signals 38 can be sent to the automotive unit 26 in the target assembly 10 for the respective operation of the remote control unit 28 (steering) and the propulsion unit 30 (movement) of the target assembly 10. As will be appreciated by the skilled artisan, in different embodiments of the control box 32 a conventional vehicle control configuration can be used or, alternatively, a single lever can be used to replace the two levers 34, 36.

Figure 4:
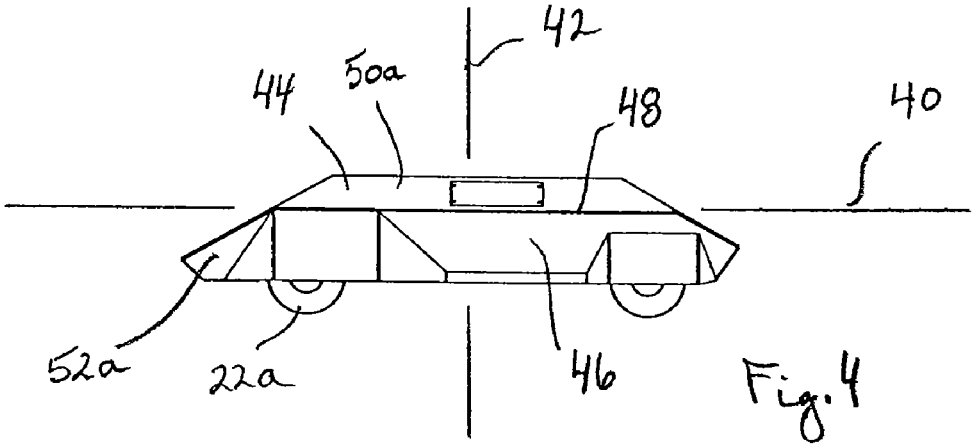
FIG. 4 is a side view of the armored shell of the target assembly.
Figure 5:
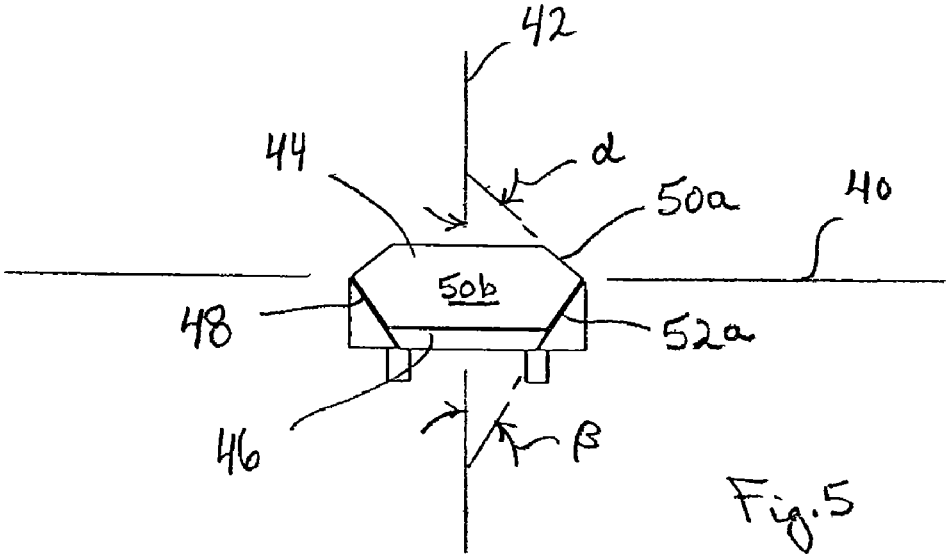
FIG. 5 is a front view of the armored shell of the target assembly.

Returning to FIG. 2, and with specific reference to the armored shell 16, it will be seen that the armored shell 16 has a unique structural configuration. In detail, the specifics of this configuration will be best appreciated by simultaneously considering views of the armored shell 16 as shown in FIGS. 2, 4 and 5. As a reference for describing the armored shell 16, consider the chassis 18 when the armored shell 16 is mounted on the chassis 18 as shown in FIGS. 4 and 5. Regardless whether considered alone, or in combination with the armored shell 16, the chassis 18 can be taken to define a base plane 40 and a central axis 42 that is substantially perpendicular to the base plane 40 (see FIGS. 4 and 5). Further, the armored shell 16 can be considered as having an upper portion 44 and a lower portion 46 that are joined together at a periphery 48.

The armored shell 16 is essentially a plurality of panels 50 that comprise the upper portion 44 (the panels 50*a* and 50*b* are exemplary), and a plurality of panels 52 that comprise the lower portion 46 (the panels 52*a* and 52*b* are exemplary). Structurally, the panels 50 in the upper portion 44 of armored shell 16 are connected to each other and, as best seen with reference to FIG. 5 (see panel 50*a*), the panels 50 are each inclined relative to the central axis 42 by an angle $\alpha$. Similarly, the panel 52 in the lower portion 46 of armored shell 16 are connected to each other, and as best seen with reference to FIG. 5 (see panel 52*a*), the panels 52 are each inclined relative to the central axis 42 by an angle $\beta$. Preferably, both the respective angles $\alpha$ and the respective angles $\beta$ are in a range between 20° to 45°. Further, the armored shell 16 includes a top plate 54 that is connected to the upper portion 44. As shown, the top plate 54 is oriented perpendicular to the central axis 42 and substantially parallel to the base plane 40. When connected to each other, the upper portion 44, the lower portion 46 and the top plate 54 enclose a hollow compartment 56. More specifically, as intended for the present invention, when the armored shell 16 is mounted on the chassis 18, the automotive unit 26 will be positioned on the cradle 24 of the chassis 18, and it will be protectively enclosed inside the compartment 56 of the armored shell 16.

The façade 14 can be of any configuration desired. Specifically, it should be designed to mimic the type of vehicle that is commonly used by indigenous personnel. More importantly, the façade 14 should be inexpensive and, if not easily repaired for reuse, should be discarded. Preferably, the façade 14 will be made of a foam plastic material and painted as desired. For the purposes of the present invention, the façade 14 can be affixed to the armored shell 16 in any way well known in the pertinent art, such as by gluing or with fasteners.

In the operation of the present invention, trainees 58 are pre-positioned in a target area 12. They are then presented with a perceived threat as a target assembly 10 is moved (driven) into the target area 12. For the present invention this movement of the target assembly 10 is accomplished by remotely controlling the target assembly 10 with a control box 32. The expected reaction in this training exercise is that the target assembly 10 will be engaged by small arms fire from the trainees 58*a,b*. The consequence of this engagement will most likely be the destruction of the façade 14. Once the live fire exercise has been completed, the destroyed façade 14 can be repaired or removed from the armored shell 16. As disclosed above, the armored shell 16 is designed to survive an attack by small arms fire. If the façade 14 cannot be repaired and instead needs to be removed, it can be easily replaced and the target assembly 10 can then be reused for a subsequent training exercise.

While the particular Ballistic Robotic Vehicle as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A mobile target assembly which comprises:

a chassis that defines a base plane and a central axis perpendicular to the base plane;

an automotive unit mounted on the chassis and engaged therewith for controlled movement of the chassis;

an armored shell formed with a compartment, wherein the armored shell is mounted on the chassis to enclose and protect the automotive unit wherein the armored shell comprises an upper portion including a plurality of panels wherein each panel of the upper portion is inclined relative to the base plane at a respective angle α, a lower portion including a plurality of panels wherein each panel of the lower portion is inclined relative to the base plane at a respective angle β, and wherein the upper portion is joined to the lower portion to establish a periphery surrounding the central axis, with each panel of the upper portion and each panel of the lower portion extending a respectively predetermined distance from the periphery, and a top plate affixed to the upper portion to establish the compartment between the top plate, the upper portion and the lower portion; and a facade formed as a land vehicle body, with the facade affixed to the armored shell to establish the assembly as a mobile vehicular target.

2. A target assembly as recited in claim 1 wherein the automotive unit comprises:

a remote control unit having a steering lever and a throttle lever; and a propulsion unit responsive to the control unit for controlled movement of the mobile vehicular target.

3. A target assembly as recited in claim 2 wherein the chassis includes a plurality of solid ballistic tires mounted thereon, and wherein at least one tire is rotated by the propulsion unit.

4. A target assembly as recited in claim 2 wherein the control unit comprises:

a steering lever; and a throttle lever.

5. A target assembly as recited in claim 1 wherein the facade is made of a plastic foam.

6. A target assembly as recited in claim 1 wherein the angle α is in a range between 20° and 45°.

7. A target assembly as recited in claim 1 wherein the angle α is in a range between 20° and 45°.

8. A target assembly as recited in claim 1 wherein the top plate and the panels are made of AR 500.

9. A mobile target assembly for use in small arms practice which comprises:

an armor-protected automotive unit with remote control for movement through a target area, wherein the armor protection provides survivability for the automotive unit in response to small arms fire;

a chassis that defines a base plane and a central axis perpendicular to the base plane, and wherein the armored protection comprises: an upper portion including a plurality of panels wherein each panel of the upper portion is inclined relative to the base plane at a respective angle α, a lower portion including a plurality of panels wherein each panel of the lower portion is inclined relative to the base plane at a respective angle β, and wherein the upper portion is joined to the lower portion to establish a periphery surrounding the central axis, with each panel of the upper portion and each panel of the lower portion extending a respectively predetermined distance from the periphery, and a top plate affixed to the upper portion to establish the compartment between the top plate, the upper portion and the lower portion; and a plurality of fungible facades, wherein a selected facade is mounted on the automotive unit, and wherein the facade is formed as a land vehicle body and is constructed for intentional destruction by the small arms fire.

10. A target assembly as recited in claim 9 wherein the angle α is in a range between 20° and 45° and the angle β is in a range between 20° and 45°.

11. A target assembly as recited in claim 9 wherein the facade is made of plastic foam.

12. A target assembly as recited in claim 9 wherein the automotive unit includes a remote control unit for steering the target assembly and a propulsion unit responsive to the control unit for controlled movement of the target assembly, and further wherein the chassis includes a plurality of solid ballistic tires mounted thereon, and wherein at least one tire is rotated by the propulsion unit.

13. A target assembly as recited in claim 9 wherein the top plate and the panels are made of AR 500.

14. A method for assembling a mobile vehicular target which comprises the steps of:

providing a chassis with an automotive unit engaged therewith for controlled movement of the chassis wherein the chassis defines a base plane and a central axis perpendicular to the base plane and formed with an upper portion including a plurality of panels wherein each panel of the upper portion is inclined relative to the base plane at a respective angle α; a lower portion including a plurality of panels wherein each panel of the lower portion is inclined relative to the base plane at a respective angle β, and wherein the upper portion is joined to the lower portion to establish a periphery surrounding the central axis, with each panel of the upper portion and each panel of the lower portion extending a respectively predetermined distance from the periphery; and a top plate affixed to the upper portion to establish the compartment between the top plate, the upper portion and the lower portion;

mounting an armored shell on the chassis, wherein the armored shell is formed with a compartment to enclose and protect the automotive unit; and affixing a facade to the armored shell, wherein the facade is formed as a land vehicle body to establish the assembly as a mobile vehicular target.

15. A method as recited in claim 14 wherein the facade is made of a plastic foam.

16. A method as recited in claim 14 wherein the automotive unit comprises:

a remote control unit having a steering lever and a throttle lever; and a propulsion unit responsive to the control unit for controlled movement of the mobile vehicular target.

17. A method as recited in claim 14 wherein angle α is in a range between 20° and 45° and wherein the angle β is in a range between 20° and 45°.

* * * * *

UNITED STATES PATENT AND TRADEMARK OFFICE

CERTIFICATE OF CORRECTION

PATENT NO. : 8,209,064 B2
APPLICATION NO. : 12/430720
DATED : June 26, 2012
INVENTOR(S) : Stuart C. Segall It is certified that error appears in the above-identified patent and that said Letters Patent is hereby corrected as shown below:

Column 5, Line 41, Claim 7, that portion of the sentence reading ".alpha." should read --.beta.--.

Signed and Sealed this
Fourteenth Day of August, 2012

David J. Kappos

David J. Kappos
*Director of the United States Patent and Trademark Office*